US007329022B2

(12) United States Patent
Tran et al.

(10) Patent No.: US 7,329,022 B2
(45) Date of Patent: Feb. 12, 2008

(54) SMALL PROFILE HANGER SYSTEM FOR CEILING SUSPENDED LIGHTING FIXTURES

(75) Inventors: Michael Trung Tran, Oakland, CA (US); Hue Ly, Richmond, CA (US)

(73) Assignee: Acuity Brands, Inc., Atlanta, GA (US)

( * ) Notice: Subject to any disclaimer, the term of this patent is extended or adjusted under 35 U.S.C. 154(b) by 28 days.

(21) Appl. No.: 11/149,939

(22) Filed: Jun. 10, 2005

(65) Prior Publication Data

US 2005/0286256 A1 Dec. 29, 2005

Related U.S. Application Data

(60) Provisional application No. 60/579,042, filed on Jun. 10, 2004.

(51) Int. Cl.
*F21S 8/00* (2006.01)

(52) U.S. Cl. ..... 362/147; 362/217; 362/404; 248/323; 248/343

(58) Field of Classification Search ..... 362/227, 362/240, 249, 401, 404, 405, 406, 217, 221, 362/648, 147; 248/317, 323, 342, 343, 344, 248/232

See application file for complete search history.

(56) References Cited

U.S. PATENT DOCUMENTS 3,001,001 A 9/1961 Bibb
3,123,310 A 3/1964 Dameral
3,158,327 A 11/1964 Dameral
3,214,580 A * 10/1965 Dameral ..... 362/219
4,420,798 A 12/1983 Herst et al.
4,706,170 A 11/1987 Herst et al.
5,282,600 A 2/1994 Weiss et al.
D411,027 S 6/1999 Herst et al.
6,530,674 B2 3/2003 Grierson et al.
6,769,785 B1 8/2004 Herst et al.

OTHER PUBLICATIONS

Peerless Lighting, "Peerlite CERRA 10", catalog, 2001.
Peerless Lighting, "Lightfoil 9", catalog, 2000.
Peerless Lighting, "Mirage Indirect/Direct 10"×3" Rounded", catalog, 2000.

* cited by examiner

*Primary Examiner*—John Anthony Ward
(74) *Attorney, Agent, or Firm*—Donald L. Beeson; Beeson Skinner Beverly, LLP

(57) ABSTRACT

An improved small profile hanger system for ceiling suspended lighting fixtures comprises a plurality of hanger assemblies having a support stem and a downwardly arced crossbar. The support stem and crossbar have a relatively small elliptical profile have two sets of wire holes, each set of wire holes having an inner hole and an outer hole overlapping the inner hole, the inner and outer holes defining an intervening gap narrower than the dimension of either hole. The holes are sized to receive an insulated wire; the intervening gap preventing the wire from crossing over into the adjacent hole. The wire holes of the support stem are in communication with the wire holes of the crossbar providing a fully enclosed wiring passage from a ballast box assembly installed above a suspended ceiling to energize a lamp in a diffuser depending from a pair of the crossbars.

31 Claims, 13 Drawing Sheets

SMALL PROFILE HANGER SYSTEM FOR CEILING SUSPENDED LIGHTING FIXTURES

CROSS-REFERENCE TO RELATED APPLICATIONS

This application claims the benefit of U.S. Provisional Application No. 60/579,042, filed Jun. 10, 2004.

BACKGROUND OF THE INVENTION

The present invention relates to lighting fixture hanger systems and particularly hanger systems for small profile ceiling suspended lighting fixtures.

Lighting for interior architectural spaces is often provided by lighting fixtures suspended from overhead ceiling structures. Examples of ceiling suspended architectural lighting fixtures include linear fluorescent fixtures comprised of linear fixture housings having a uniform cross-sectional shape. Such fixtures are typically suspended by steel aircraft cable or rigid hollow stems, and would have relatively bulky power cords that would have to be run up through the ceiling for connection to an electrical junction box. Where fixtures are suspended by aircraft cable, the power cord for each fixture would normally be run up and sometimes wrap around the suspension cables; in the case of stem suspensions, the power cord would be run up through the hollow stem. While stems have the advantage that they hide the power cord, they are themselves relatively large in diameter and do not contribute to an aesthetically pleasing hanger system, and particularly hanger systems having small profiles.

A need exists for a hanger system that can be used to suspend relatively small profile lighting fixtures, such as linear fluorescent lighting fixtures that have been devised for compact T-5 lamps. A need also exists for a hanger system having components of a smaller profile than exists in large diameter stems, while allowing for the wiring of the fixture through the hanger system. A need further exists for a hanger system that allows wires to be pulled through the hanger system components relatively easily without becoming tangled. Yet another need exists for a small profile, lightweight hanger system that is relative easy to install, and that is physically and aesthetically compatible with small profile lighting fixtures.

SUMMARY OF THE INVENTION

The invention is directed to a small profile hanger system for suspending linear fluorescent lighting elements below a grid ceiling system and a hanger assembly used with such a system. The hanger system is comprised of an elongated ballast box adapted to be mounted above a grid ceiling system and having a length that at least substantially spans the special separation between the end portions of the linear lighting elements suspending by the hanger system. The system also includes at least two hanger assemblies for suspending the linear fluorescent lighting elements below the grid ceiling. Each of said hanger assemblies includes a vertical support stem and a transverse crossbar. The support stem has first and second pairs of side-by-side wire holes running therethrough which exit the top and bottom of the support stem. The ton of said support stem is adapted for securement to said ballast box along the length of the ballast box, and preferably at the ends ballast box, so as to depend downwardly therefrom and so as to provide a special separation between hangers compatible with the special separation of the end portions of the linear lighting elements suspending by the hanger system. The transverse hanger crossbar has first and second hanger ends which extend in opposite directions from its mid-portion for connecting to the linear lighting elements suspended by the hanger system, and to do so near the lamp sockets held therein. The crossbar further has at least one pair of side-by-side wire holes running from its mid-portion to the first of its hanger ends, and at least one pair of side-by-side wire holes running from its mid-portion to the second of its hanger ends. Each of the at least one pair of wire holes in the crossbar exits the mid-portion of the crossbar and the respective hanger ends of said crossbar. The bottom of the support stem is connectable to the mid-portion of the crossbar such that the first and second pairs of wire holes running through the support stem communicate with the pairs of wire holes in the crossbar. Whereby wires can be pulled through the support stem and crossbar and the crossbar connected to the bottom of the support stem for wiring a ballast in said ballast box to the lamp sockets in the end portions of the linear lighting elements suspended from the ballast box by said hangers. Preferably. Cross-section profile of the support stem and crossbar of each hanger is an elongated profile, such as an elliptical or "cats-eve " shape, with the side-by-side wire holes of each pair of wire holes being aligned in the direction of the wide dimension of the elongated profiles.

The improved hanger system and hanger assembly of the invention has a relatively small profile, provides a hidden wiring passage for extending wiring from the ballast above the ceiling to the lamp or lamps in the suspended linear fluorescent lighting elements, and the entire system is easy to assemble. The support stem and crossbar elements of the hangers used in the system can suitably be fabricated of extruded aluminum to produce hangers that are not only light in appearance, but light in weight.

BRIEF DESCRIPTION OF THE ILLUSTRATIONS

DESCRIPTION OF THE ILLUSTRATED EMBODIMENT

With reference to the attached illustrations, a ceiling suspended lighting fixture 10 comprises a hanger assembly 12, dual elongated indirect lighting fixture elements 14 preferably having T-5 high output fluorescent lamps, and a ballast box assembly 16.

Figure 5:
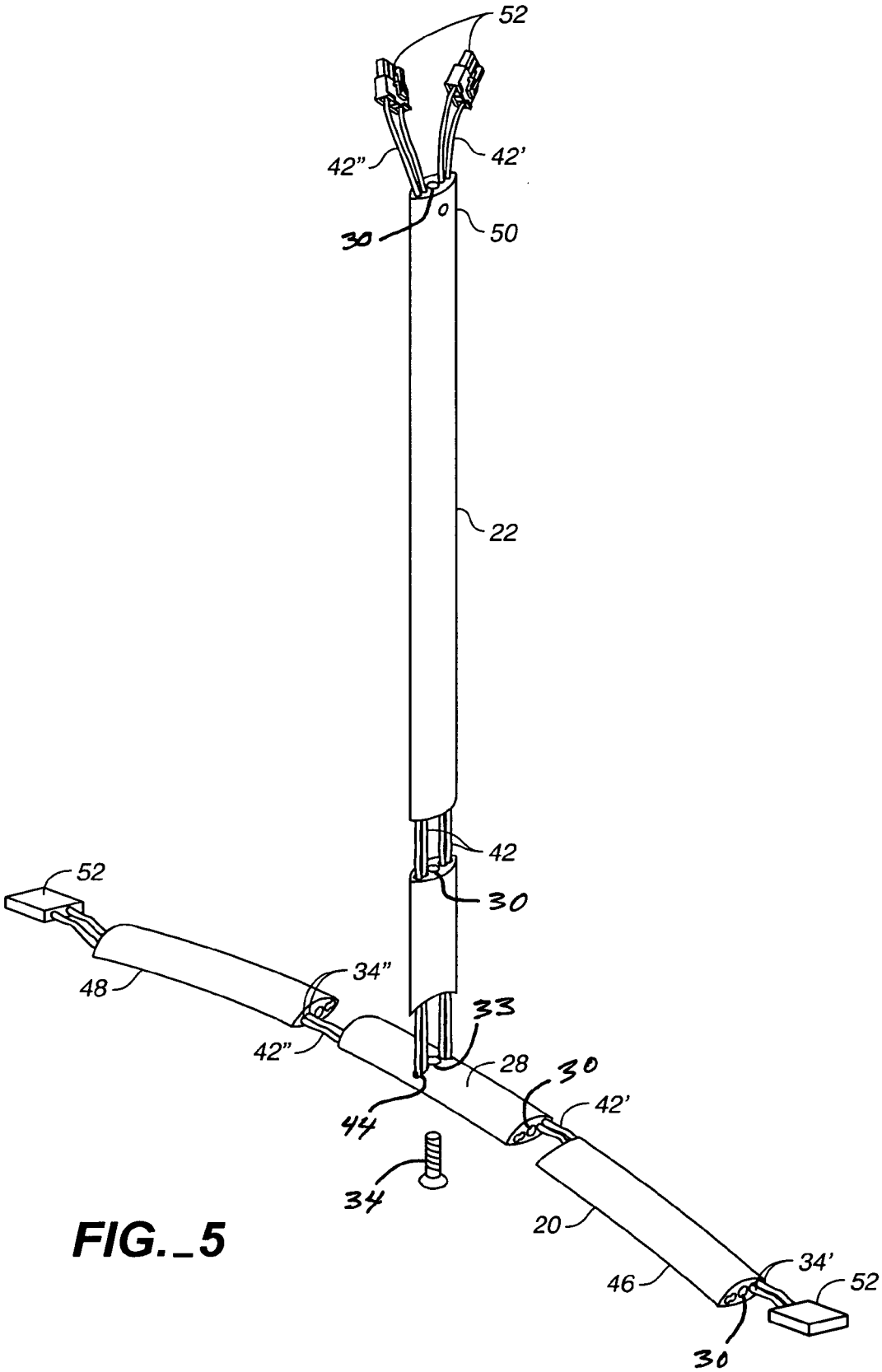
FIG. 5 is a top perspective view, partially cut-away, of one of the hangers for the indirect lighting fixtures shown in FIG. 1.

The hanger assembly 12 comprises a pair of hangers for suspending the ends of the indirect lighting fixture elements 14. Each hanger has a downwardly arched crossbar 20 depending from a vertical support stem 22. The crossbar 20 and support stem 22 are suitably made from extruded aluminum with a heavy etched surface. In the preferred embodiment, the crossbar 20 and support stem 22 have a common generally elliptical cross-section best seen in FIG. 7A, but alternate embodiments could assume other shapes such as a diamond-shaped or cylindrical cross-section. Referring now to FIG. 7, a lower end 24 of the support stem 22 terminates in an concave surface 26 for mating engagement with the convex outer surface 28 of the crossbar 20 as perhaps best seen in FIG. 5. A center bore 30 extends through the entire length of both the support stem 22 and the crossbar 20. At the lower end 24 of the support stem 22 the center bore 30 has a threaded portion 32. As shown in FIG. 6A a vertical hole 33 is provided in the crossbar 20 to accept a threaded fastener 34. The crossbar 20 is attached to the support stem 22 with the threaded fastener 34 which engages the threaded portion 32 of the center bore 20 of the support stem 22. In the preferred embodiment, the bottom portion 35 of the bore 20 is cone-shaped to accommodate a beveled-head screw. It will be appreciated that other hole entrance shapes could be used. A self-locking screw may be used to prevent the screw from loosening over time.

Referring again to FIG. 7A, two pairs of wire holes 37 extend through the entire length of both the support stem 22 and crossbar 20. Each pair of wire holes comprises an inside hole 36 and an outside hole 38. The inside and outside holes 36, 38 overlap forming an intermediate gap 40. The inside hole 36 of each hole pair is slightly smaller than the outside hole 38. The small reduction in the size of the inside hole 36 permits a corresponding increase in the amount of material in the cross-sections of the crossbar 20 and the support stem 22 for improved strength. This, in turn, allows reduction of the cross-section of the hanger elements 20, 22 to a more compact size. Preferably, the narrow diameter N of the cross-section is approximately 0.358" and the widest diameter W is 0.750", but the invention is not limited to those dimensions, the cross-section capable of assuming myriad dimensions in alternate embodiments. In the preferred embodiment, the pairs of wire holes are in planar alignment with he widest diameter of the profile as seen in FIGS. 6A and 7A.

Referring again to FIG. 5, each hole 36, 38 is sized to receive an 18 gauge insulated wire 42 such that a pair of like wires can easily be fed through the holes without becoming entangled. Conversely, the hole is sufficiently small that when a wire is fed into one of the holes it is unlikely to bend. The intermediate gap 40 between holes 36, 38 is sufficiently smaller than the diameter of the 18-gauge wire that the wires 42 do not cross over into the adjacent hole when they are being fed through the wire holes 37. It will be readily appreciated by those of skill in the art, that the invention is not limited to 18 gauge insulated wire and holes sized to receive 18 gauge insulated wire, and that other embodiments of the invention could have other wire and hole sizes.

Figure 6:
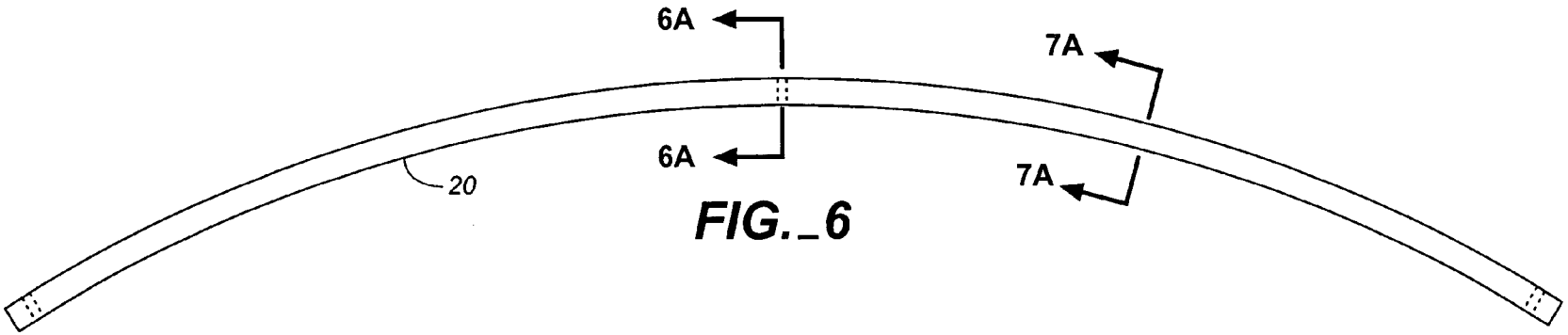
FIG. 6 is a side elevational view of the curved cross-piece of the hanger shown in FIG. 5.
Figure 6A:
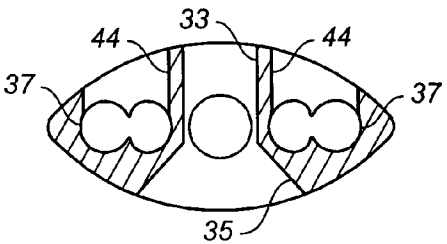
FIG. 6A is a cross-sectional view thereof taken along lines 6A-6A of FIG. 6.
Figure 7:
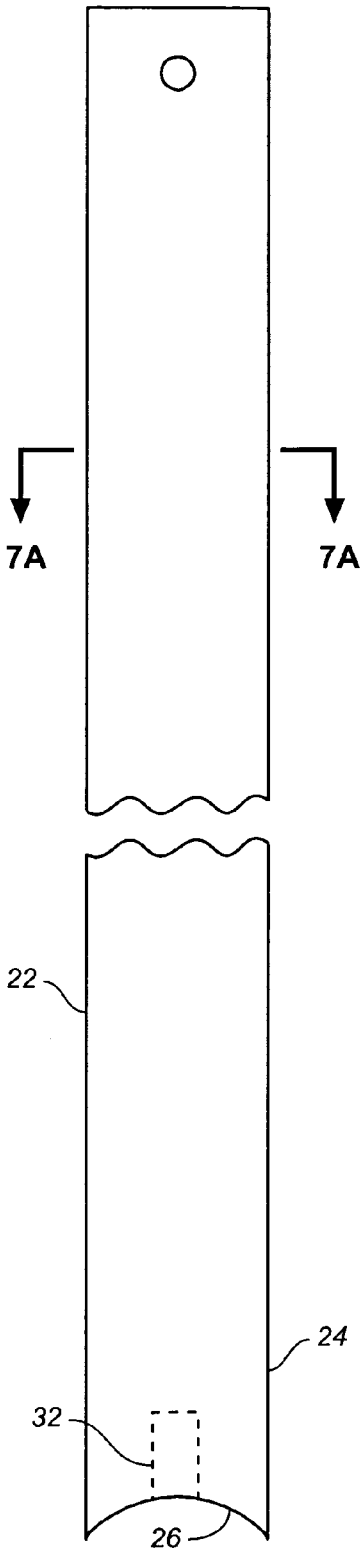
FIG. 7 is a side elevational view of the vertical support stem of the hanger shown in FIG. 5.
Figure 7A:
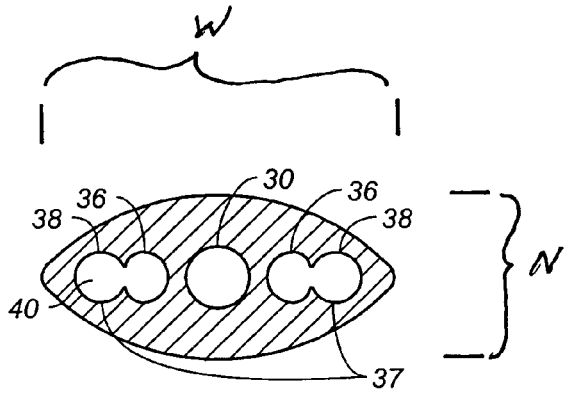
FIG. 7A is a cross-sectional view thereof taken along lines 7A-7A of FIG. 7.
Figure 7B:
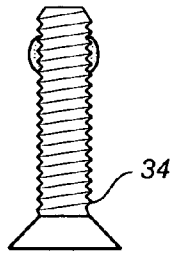
FIG. 7B is a side elevational view of the locking screw used to attach the curved crossbar shown in FIG. 6 with the vertical support stem shown in FIG. 7.

Referring to FIGS. 6 and 6A, wire exit ports 44 in the top side of the mid-portion or apex of the crossbar 20 intersect with the wire holes 37 in the support stem 22. Accordingly, with additional reference to FIG. 5, construction of the hanger assembly 12 involves feeding a first pair of lamp wires 42' into a first pair of wire holes 34' from a first end 46 of the crossbar 20. When the wire ends appear in the exit port 44 they are then fished out and fed through a corresponding pair of wire holes 34 in the support stem 22. Similarly, a second pair of lamp wires 42" are fed into the second pair of wire holes 34Δ from a second end 48 of the crossbar 20 until their ends appear in the intersecting exit port 44. The second pair of lamp wires 42" are then fished out and fed through the corresponding pair of wire holes 34 in the support stem 22. Once the crossbar 20 is attached to the support stem 22, the first pair of lamp wires 42' will extend from the first end 46 of the crossbar 20 to the top end 50 of the support stem 22 and the second pair of lamp wires 42" will extend from the second end 48 of the cross beam 20 to the top end 50 of the support stem 22, both pairs of lamp wires 42 being completely enclosed and hidden from view within the hanger elements. Incorporating the wire holes 37 in the hanger elements 20, 22 provides a fully enclosed wiring passage for wiring of the fixture element 14 to the ballast through the hanger elements. Snap connectors 52 are attached to the ends of each pair of lamp wires.

Figure 2A:
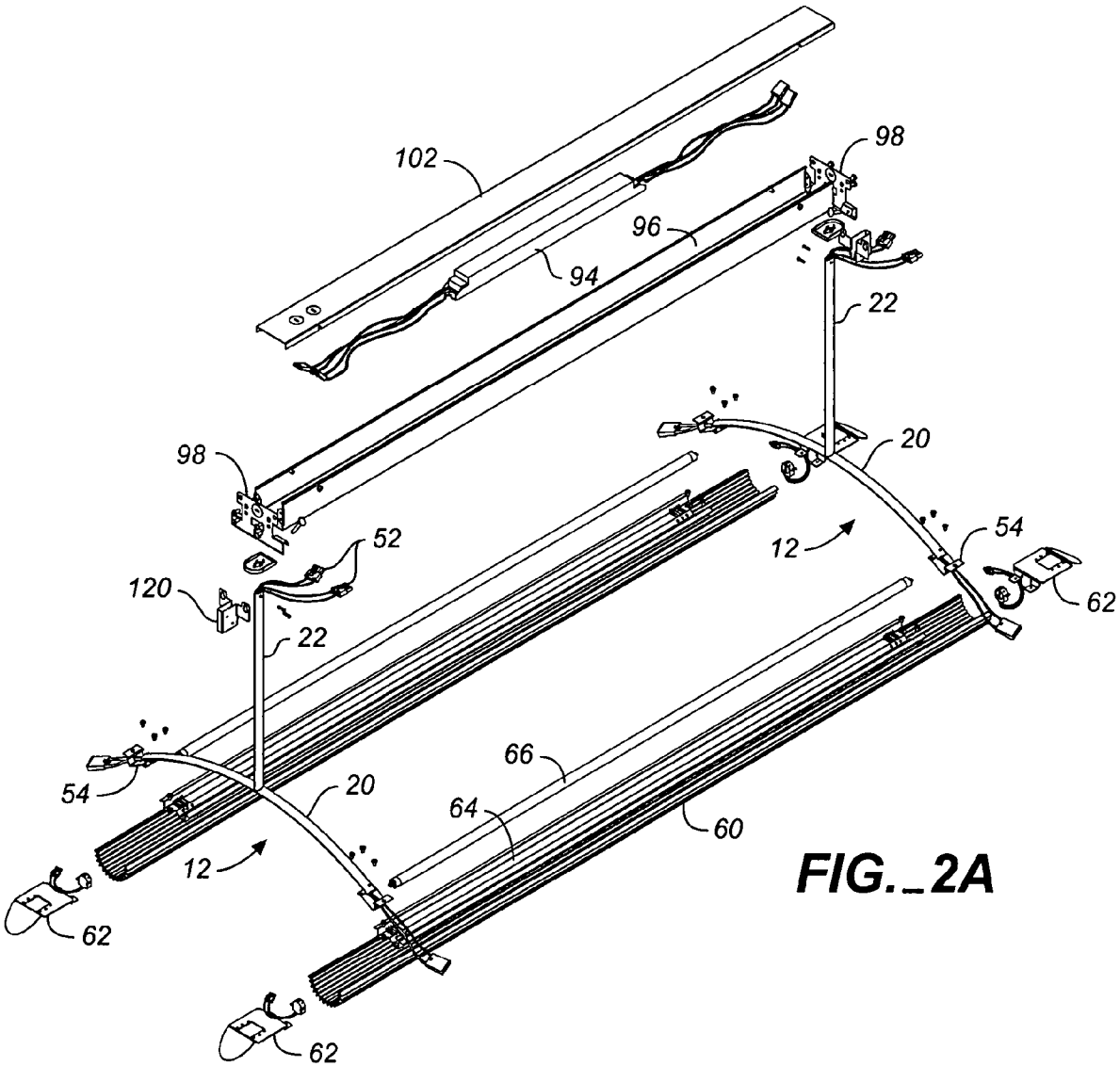
FIG. 2A is an exploded view thereof.
Figure 2B:
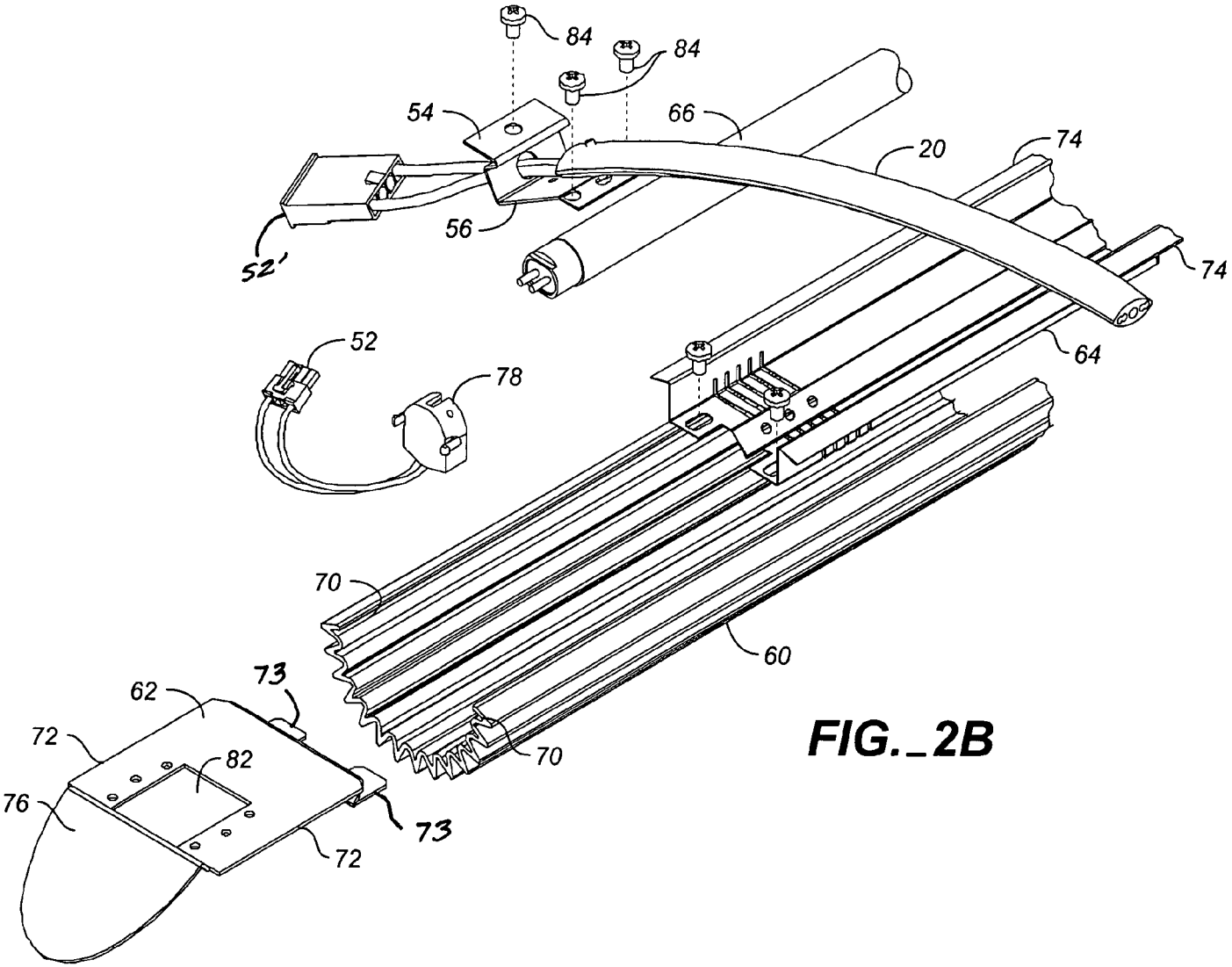
FIG. 2B is an exploded fragmentary view thereof showing in greater detail the connection of the hanger system of the invention to one of the lighting fixtures of the assembly.
Figure 2C:
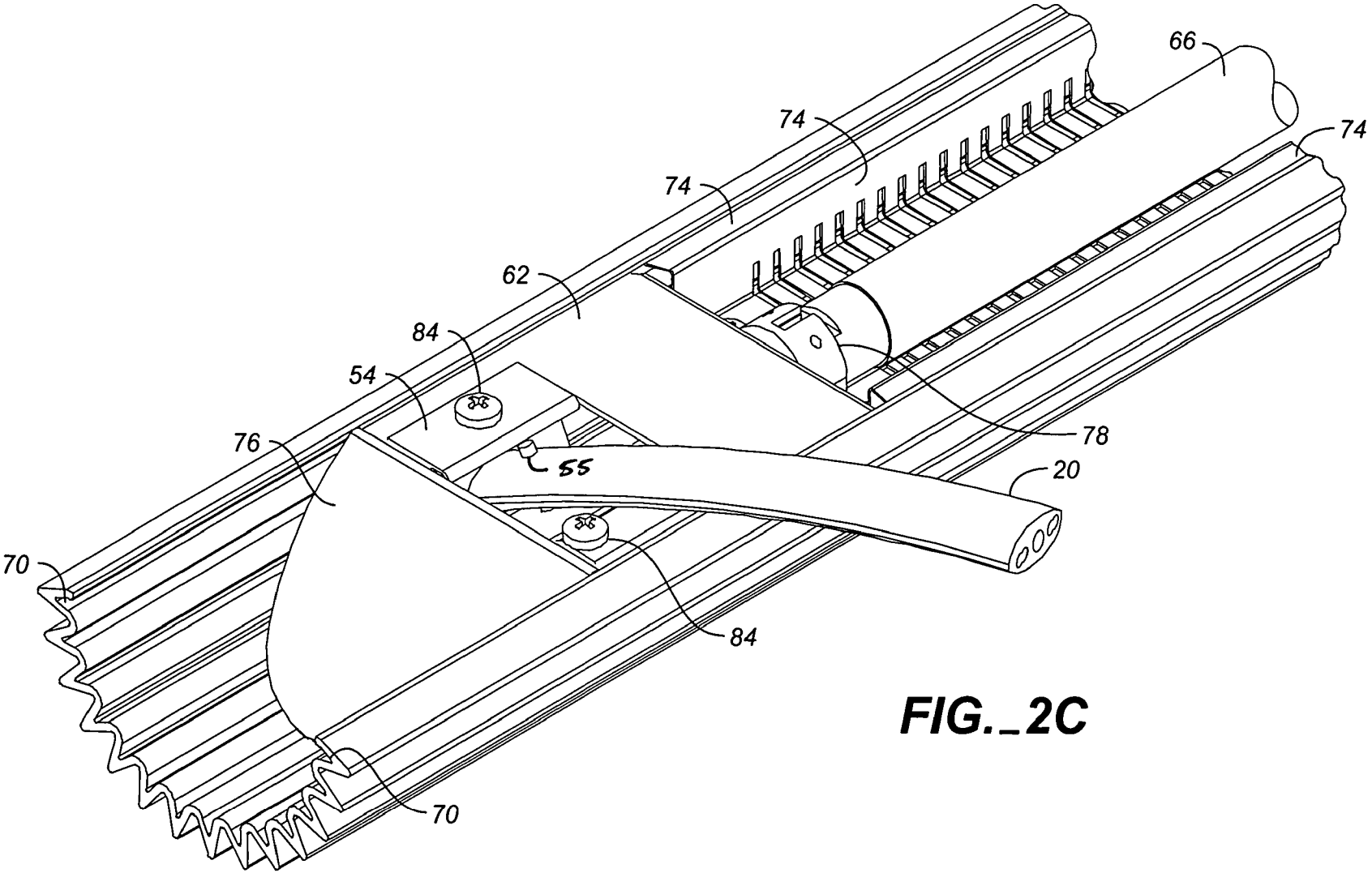
FIG. 2C is a fragmentary view of the portion of the assembly shown in FIG. 2B fully assembled.

Referring to FIGS. 2B and 2C, connector brackets 54 are attached to each end of the crossbar 20 with a threaded fastener 55 from beneath. Each connector bracket 54 includes a bottom channel portion 56 for receiving the ends of the crossbar 20.

Figure 2D:
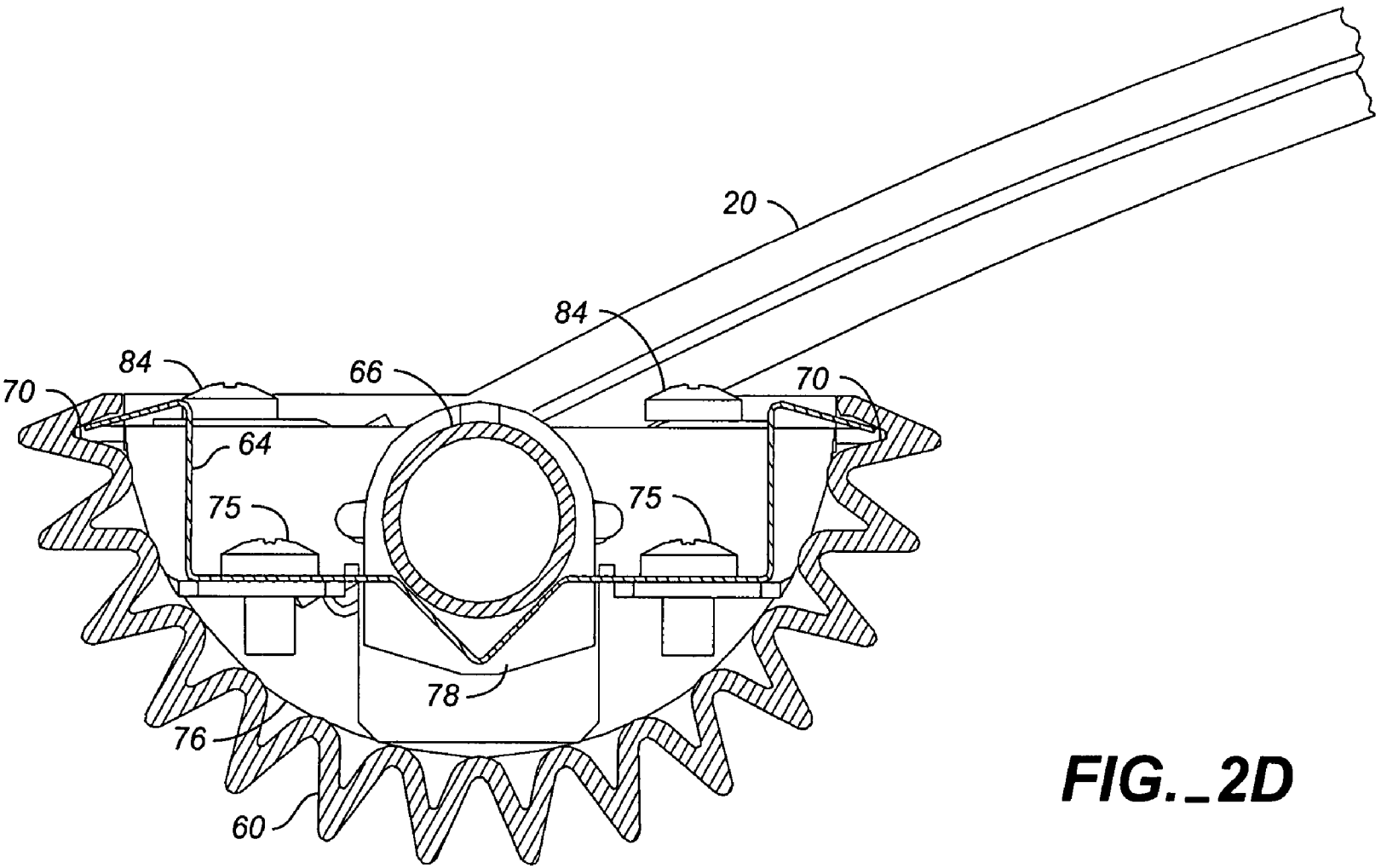
FIG. 2D is a cross-sectional view of one of the lighting fixtures suspended by the hanger system of the invention as shown in FIG. 1.
Figure 3:
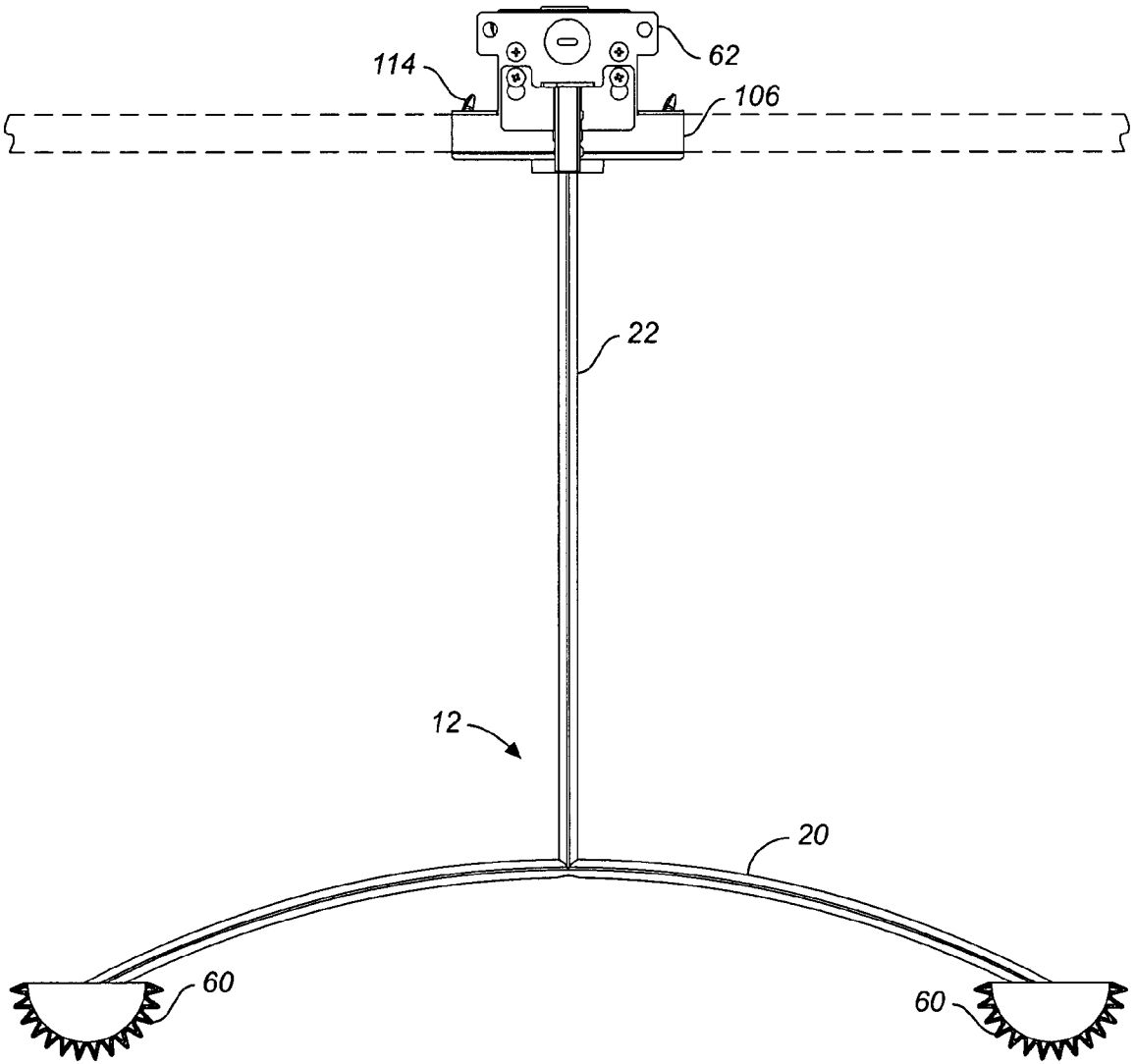
FIG. 3 is an end elevational view of the small profile indirect lighting fixtures and a hanger system shown in FIG. 1.

Each indirect lighting fixture element 14 comprises a diffuser housing 60, an end plate 62, a reflector 64, and a lamp 66. As best seen in FIG. 3 the diffuser housing 60 preferably has a generally annular cross-section with a crenulated profile. The upper portions of the sides of the diffuser housing terminate in opposing recesses 70. See FIG. 2D. Laterally extending flanges 72 on the sides of the end plate 62 (see FIG. 2B) slide into the recesses 70. The width across the end plate 62 to the outer edges of the flanges 72 is slightly larger than the outermost extent of the recesses 70 of the diffuser housing 60 such that insertion of the end plate 62 between the recesses 70 requires the diffuser to flex outwardly slightly causing the diffuser housing 60 to bias inwards effectively holding the end plate 62 longitudinally in place. Similarly, laterally projecting flanges 74 on the reflector 64 slidingly inserted into the recesses 70 of the diffuser housing 60 retain the reflector 64 in the diffuser housing 60. The reflector 64 is interposed between end plates 62 installed on each end of the diffuser housing 60 and secured to each inwardly extending tabs 73 on the end plates with fasteners 75. The outer end of each end plate 62 has a downwardly angled cover plate 76 having a parabolic periphery for intersecting with the inside of the diffuser housing 60 as seen in FIG. 2C. A lamp socket 78 is attached to the inner end of each end plate 62 to allow a lamp 66 to be mounted in the diffuser housing 60. Each lamp socket is back-wired and snap connectors 52 are attached to the wires. On the top side of each end plate 62 a mounting hole 82 is provided to receive the recessed portions 56 of the connector brackets 54 of the hanger assembly 12. Once the snap connector 52 at the end of the crossbar 20 is connected to the cooperating snap connector 52' of the lamp socket 78, the bottom channel portion 56 of the connector bracket 54 is inserted through the mounting hole 82 in the end plate 62 and secured to the end plate 62 with threaded fasteners 84.

Figure 1:
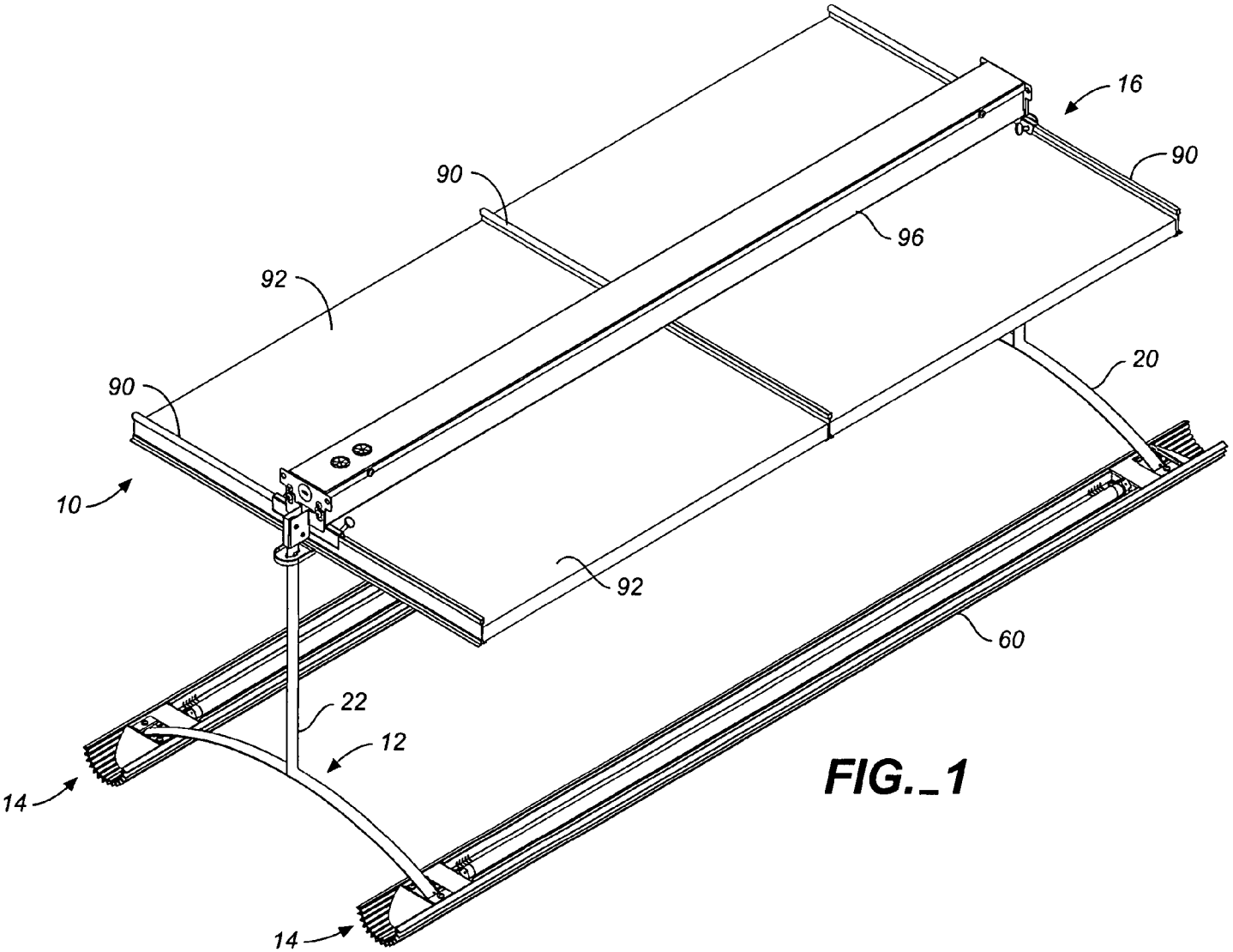
FIG. 1 is a top perspective view of a lighting assembly comprised of small profile indirect lighting fixtures and a hanger system in accordance with the invention for suspending the lighting assembly below a grid ceiling system.
Figure 4:
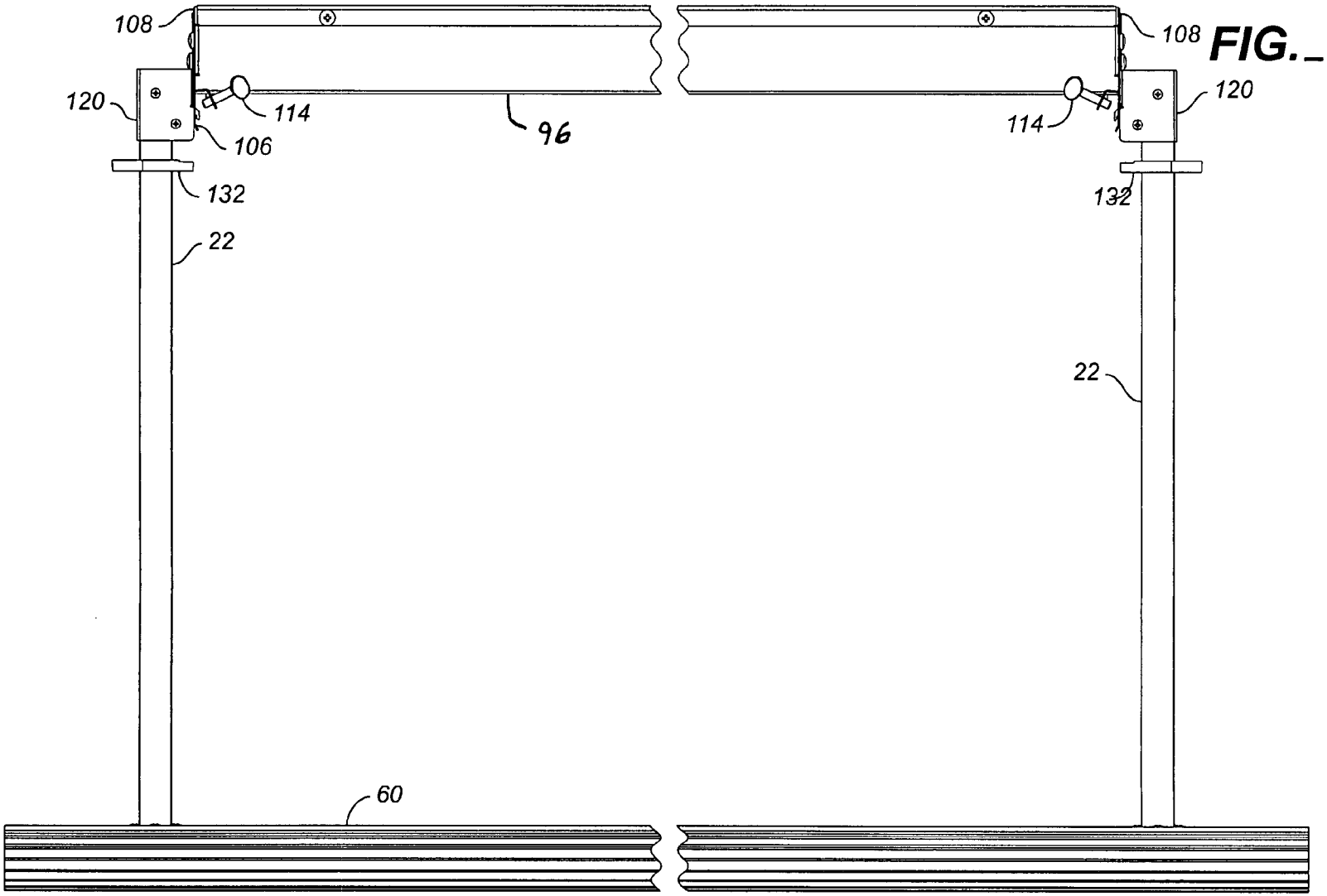
FIG. 4 is a side elevational view thereof.
Figure 8:
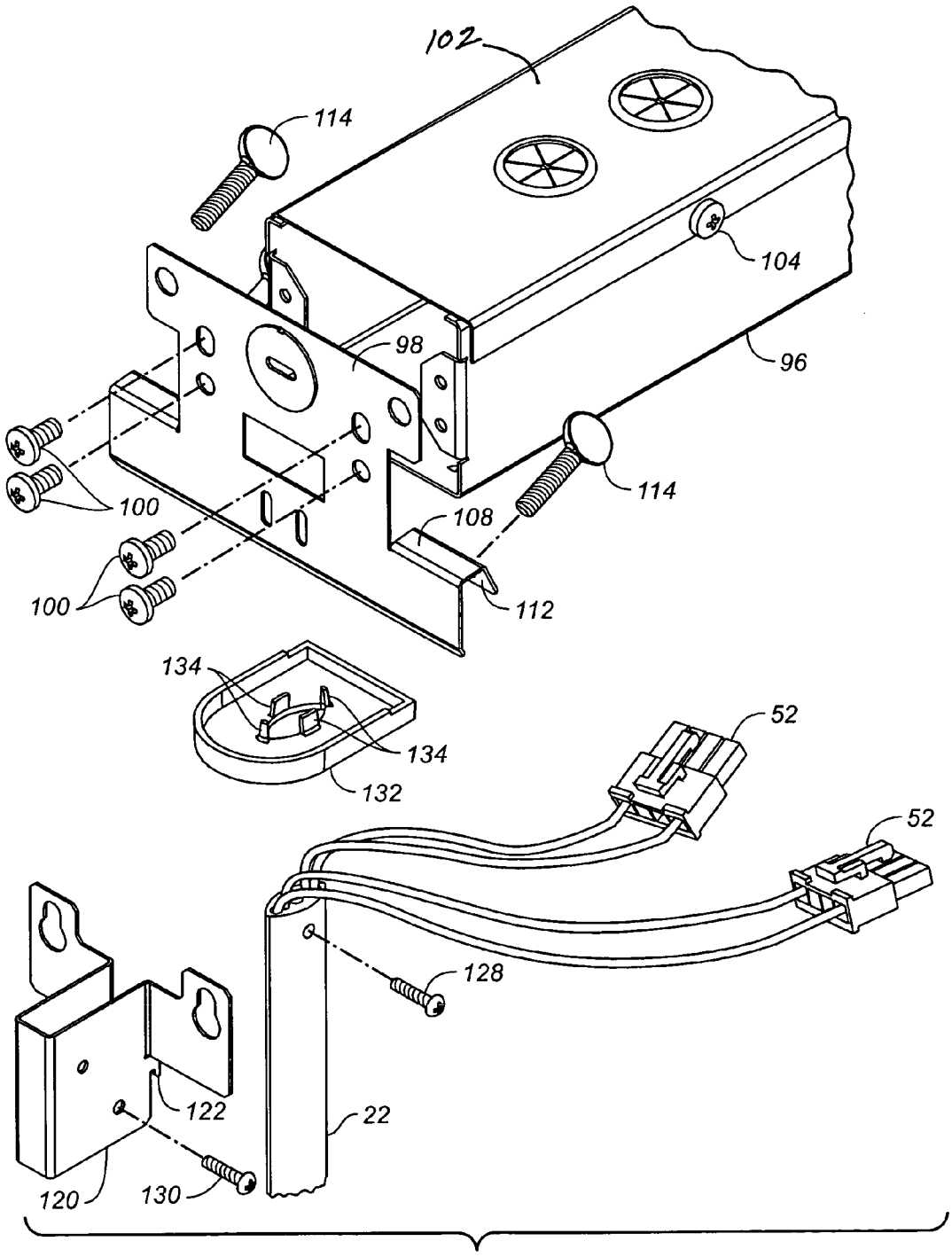
FIG. 8 is and exploded top perspective view of the end of the ballast box and of the hanging hardware used for hanging the indirect lighting fixtures in FIG. 1 from the ends of the ballast box.

As shown in FIG. 1, a ceiling suspended light fixture 10 according to the invention is installed in a ceiling system comprised of a grid of T-bars 90. The ceiling tiles 92 are supported by and between adjacent T-bars. With reference now to FIG. 2A, a ballast 94 is disposed in a ballast box 96. Referring also to FIG. 8, end caps 98 are attached to each end of the ballast box 96 with threaded fasteners 100, and a ballast box cover 102 is secured to the top of the ballast box 96 with threaded fasteners 104. With additional reference to FIG. 4, it is seen that a lower portion 106 of the end cap 98 extends below the ballast box 96. Support brackets 108 (see FIG. 8) project inwardly from the lower portion 106 for resting on a T-bar 90 so that the lower portion 106 of the end cap 98 rests against a first side 110 of the T-bar 90. See FIG. 9. An inner lip 112 projects downwardly at an oblique angle to ease installation of the support brackets 108 on the T-bar grid. With reference to FIG. 10, thumbscrews 114 are inserted through the inner lip 112 such that when tightened the thumbscrews 114 advance towards a second side 116 of the T-bar 90 to secure the T-bar 90 between the lower portion 106 and the thumbscrew 114. A T-bar of typical construction has an enlarged head 118. Thus, the downward angle of the thumbscrew 114 helps ensure that when fully tightened its end is disposed below the head 118 of the T-bar 90. The configuration of the support brackets 108 thus securely locks the end caps 98 both horizontally and vertically on the T-bar grid. See FIGS. 9 and 10.

Figure 9:
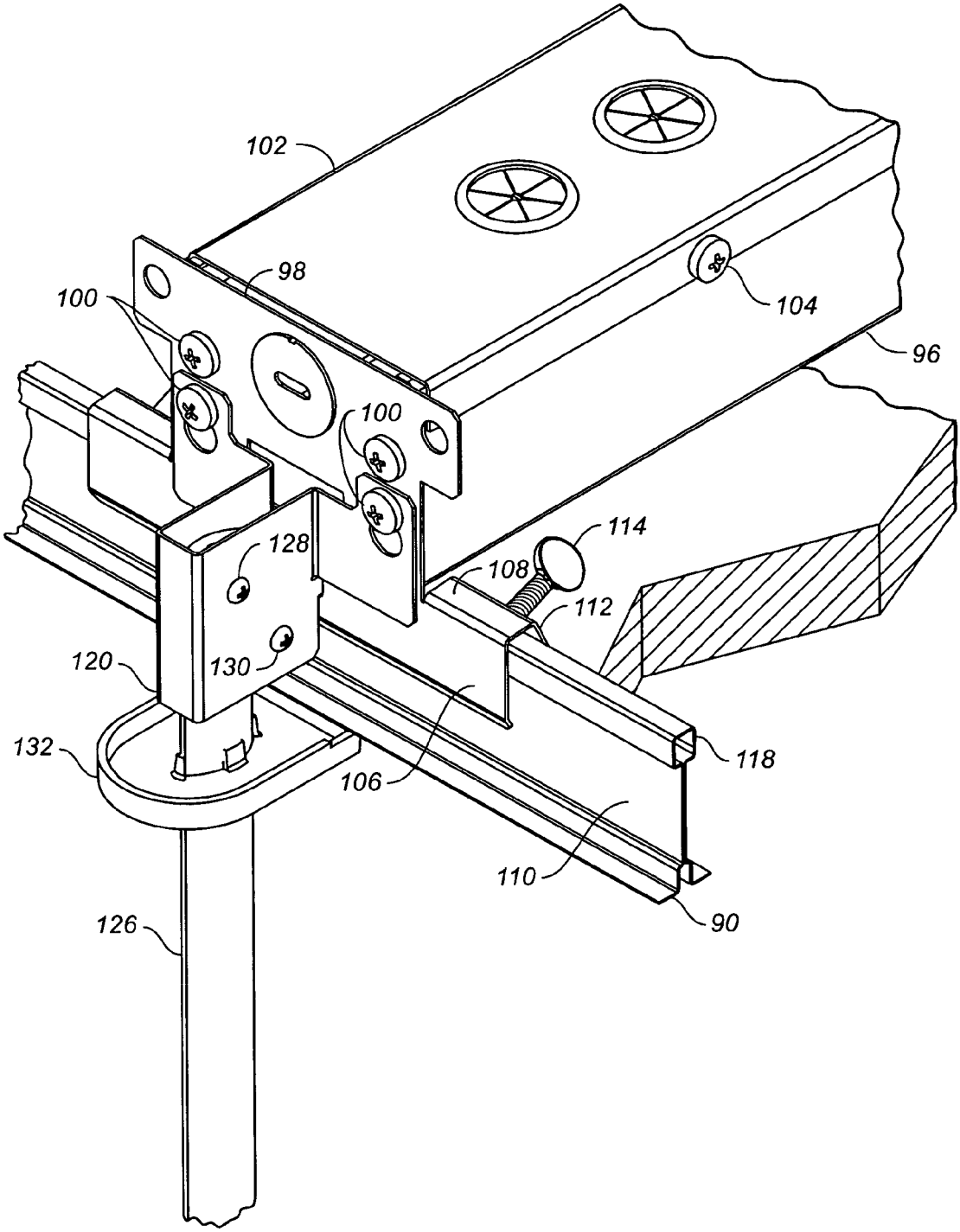
FIG. 9 is an assembled top perspective view thereof.
Figure 10:
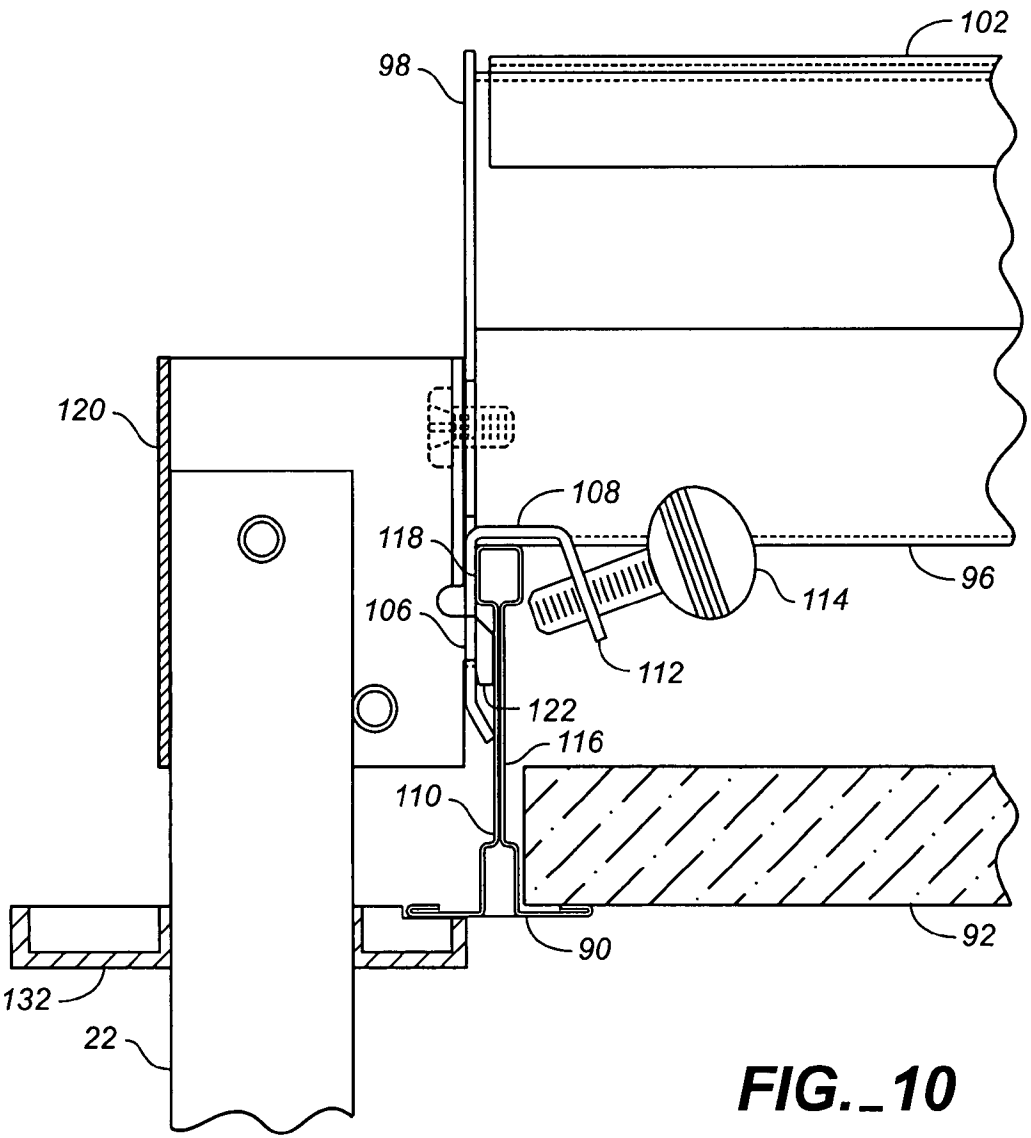
FIG. 10 is an assembled side elevational view thereof.

A hanger bracket 120 is attached to each end cap 98 first by inserting hooks 122 into openings 124 then pressing the hanger bracket 120 down to secure the hooks in the openings as shown in FIGS. 8-10. The hanger bracket 120 is then fastened to the end cap 98 with threaded fasteners 100. Dual fastening of the hanger bracket 120 to the end cap 98 using the hooks 122 and fasteners 100 prevents the hanger bracket from rocking, e.g., in the event of an earthquake. The upper end 126 (see FIG. 9) of the support stem 22 attaches to the hanger bracket 120 with a threaded fastener 128. A laterally displaced lower fastener 130 inserted in the hanger bracket 120 immediately adjacent the support stem 22 squeezes the hanger bracket 120 firmly around the support stem 22. During field installation of the fixture, a small portion (not illustrated) of a ceiling tile 92 is removed to create a ceiling aperture through which the support stem 22 is inserted. A canopy 132 is installed on the support stem 22 to mask the ceiling aperture. Fingers 134 bias inwardly to hold the canopy onto the support stem 22. The hanger assembly 12 and diffuser assemblies 14 are thus suspended from the ballast assembly 16, the latter being hidden from view above the ceiling tiles.

A suspended ceiling fixture 10 as described is easy to assemble and install, is fabricated from standard aluminum materials which are strong enough to hold the weight of the fixture elements at their outboard ends yet retain a small and aesthetically pleasing compact profile, and is light weight, the illustrated embodiment of the hanger and diffuser assemblies weighing less than 5 lbs. The lightness of the fixture may avoid triggering earthquake code requirements in earthquake prone areas for suspended ceiling fixtures.

There have thus been described certain preferred embodiments of an improved small profile hanger system for ceiling suspended lighting fixtures. While preferred embodiments have been described and disclosed, it will be recognized by those with skill in the art that modifications are within the true spirit and scope of the invention. The appended claims are intended to cover all such modifications.

We claim:

1. A hanger system for suspending linear fluorescent lighting elements below a grid ceiling system wherein said linear fluorescent lighting elements have spacially separated end portions holding at least one pair of opposed lamp sockets for holding at least one fluorescent lamp, said hanger system comprising:

an elongated ballast box adapted to be mounted above a grid ceiling system and having a length that at least substantially spans the spacial separation between the end portions of the linear lighting elements suspending by the hanger system, and at least two hanger assemblies, each of said hanger assemblies being comprised of:

a vertical support stem having a top and a bottom and first and second pairs of side-by-side wire holes running therethrough which exit the top and bottom thereof, the top of said support stem being adapted for securement to said ballast box so as to depend downwardly therefrom and so as to provide a spacial separation between hanger assemblies compatible with the spacial separation of the end portions of the linear lighting elements suspending by the hanger system, a transverse hanger crossbar having a mid-portion and first and second hanger ends which extend in opposite directions from said mid-portion for connecting to the linear lighting elements suspended by the hanger system near the lamp sockets held therein, said crossbar further having at least one pair of side-by-side wire holes running from the mid-portion thereof to the first of said hanger ends thereof, and at least one pair of side-by-side wire holes running from the mid-portion thereof to the second of said hanger ends, each of said at least one pair of wire holes in said crossbar exiting the mid-portion of the crossbar and the respective hanger ends of the crossbar, each wire hole of each of the pairs of wire holes in said support stem and crossbar being sized to slidably receive a pair of insulated wires pulled therethough, and the bottom of said support stem being connectable to the mid-portion of said crossbar such that the first and second pairs of wire holes running through said support stem communicate with the pairs of wire holes in said crossbar, whereby continuous wires can be pulled through the support stem and crossbar, and whereby the crossbar can be connected to the bottom of the support stem for wiring a ballast in said ballast box to the lamp sockets in the end portions of the linear lighting elements suspended by said hanger assemblies.

2. The hanger system of claim 1 wherein each of the pairs of wire holes in the support stem and crossbar of said hangers overlap to create an intermediate gap between the side-by-side wire holes of each of said pairs, said intermediate gap being sufficiently small that an insulated wire in one of the wire holes of said pair of wire holes cannot cross over into the other of the wire holes of said pair.

3. The hanger system of claim 1 wherein said support stem and said crossbar each have a common cross-sectional profile.

4. The hanger system of claim 1 wherein said support stem and said crossbar each have an elongated cross-sectional profile with a narrow dimension and a wide dimension, and wherein the pairs of wire holes in said support stem and crossbar are in side-by-side alignment with the wide dimension thereof.

5. The hanger system of claim 1 wherein the pairs of wire holes in said crossbar are comprised of at least one pair of wire holes that run between the hanger ends over the entire length thereof and wherein an exit port is provided at the mid-portion of the cross-bar for said wire holes.

6. The hanger system of claim 5 wherein said support stem and said crossbar are fabricated of extruded aluminum.

7. The hanger system of claim 1 wherein said crossbar has first and second pairs of wire holes running from the mid-portion of said cross-bar to both the first and second hanger ends of said crossbar such that a pair of wire holes is provided at each hanger end of the crossbar corresponding to one of the first and second pairs of wire holes running through said support stem.

8. The hanger system of claim 1 wherein said crossbar has a downwardly arched shape having a apex at its mid-portion, and wherein the pairs of wire holes in said crossbar exit at the apex thereof and wherein the bottom of said support stem is connects to the apex of said crossbar.

9. The hanger system of claim 1 wherein said ballast box terminates at ends having a spacial separation compatible with the spacial separation of the end portions of the linear lighting elements suspending by the hanger system, and wherein the tops of the support stems of said hangers are releasably securable to said ballast box at the ends thereof.

10. The hanger system of claim 9 wherein a hanger bracket is provided at the top of the support stem of each of said hangers, and wherein said hanger bracket and the ends of said ballast box include complimentary engaging means for releasably securing the hanger bracket to the ends of said ballast box.

11. The hanger system of claim 10 wherein each of the support stem hanger brackets are comprised of an outwardly extending U-shaped vertical channel sized and shaped to capture the top of the support stem of one of said hanger assemblies, fastening means for securing the top of the support stem of the hanger assembly in said U-shaped channel, and a flanged portion extending laterally of said U-shaped channel, the flanged portion of said hanger bracket and the ends of said ballast box including complimentary engaging means for releasably securing the flanged portion of the hanger bracket to the ends of said ballast box.

12. A hanger system for suspending linear fluorescent lighting elements below a grid ceiling system wherein said linear fluorescent lighting elements have spacially separated end portions holding at least one pair of opposed lamp sockets for holding at least one fluorescent lamp, said hanger system comprising:

an elongated ballast box adapted to be mounted above a grid ceiling system and having a length that at least substantially spans the spacial separation between the end portions of the linear lighting elements suspending by the hanger system, and at least two hanger assemblies, each of said hanger assemblies being comprised of:

a vertical support stem having a top and a bottom, the top of said support stem being adapted for securement to said ballast box so as to depend downwardly therefrom and so as to provide a spacial separation between hanger assemblies compatible with the spacial separation of the end portions of the linear lighting elements suspending by the hanger system, a transverse hanger crossbar having a mid-portion, wire exit ports at said mid-portion, and first and second hanger ends which extend in opposite directions from said mid-portion for connecting to linear lighting elements suspended by the hanger system near the lamp sockets held therein, said support stem and crossbar having complimentary elongated cross-sectional profiles with a narrow dimension and a wide dimension, and first and second pairs of side-by-side wire holes running therethrough, the first and second pairs of wire holes in said support stem exiting the top and bottom thereof, and the first and second pairs of wire holes in said crossbar exiting the crossbar at the first and second hanger ends thereof and at the wire exit ports at the mid-portion thereof, the first and second pairs of wire holes in said support stem and crossbar being arranged in side-by-side alignment with the wide dimensions thereof, and the wire holes of each of such pairs of wire holes overlapping to create an intermediate gap therebetween, said intermediate gap being sufficiently small that an insulated wire in one of the wire holes of said pair of wire holes cannot cross over into the other of the wire holes of said pair, and the bottom of said support stem being connectable to the mid-portion of said crossbar such that the first and second pairs of wire holes running through said support stem communicate with the first and second pairs of wire holes in said crossbar, whereby wires can be pulled through the support stem and crossbar, and whereby the crossbar can be connected to the bottom of the support stem for wiring a ballast in said ballast box to the lamp sockets in the end portions of the linear lighting elements suspended from said ballast box by said hanger assemblies.

13. The hanger system of claim 12 wherein said support stem and crossbar have a center bore running therethrough between said pairs of wire holes, the center bore of said support stem exiting the top and bottom thereof between wire holes pairs, and the center bore of said crossbar exiting the hanger ends thereof between wire hole pairs.

14. The hanger system of claim 13 wherein the center bore in said support stem is threaded at the bottom of the support stem, and wherein a fastener hole extends through the mid-portion of said crossbar between the exit ports thereat for accepting a screw fastener that can be screwed into the threaded bore at the bottom of the support stem for connecting the bottom of the support stem to the crossbar, said fastener hole being located such that the exit ports at the mid-portion of said crossbar align with the pairs of wire holes exiting the bottom of the support stem when the crossbar is connected to the support stem.

15. The hanger system of claim 13 wherein each wire hole pair in said support stem and crossbar has an inside wire hole that is adjacent the center bore in said support stem and crossbar, and wherein each said inside wire hole is smaller than the other wire hole of said pair.

16. The hanger system of claim 12 wherein the wide dimension for the cross-sectional profile of said support stem and cross-bar is no greater than approximately ¾ inch.

17. The hanger system of claim 12 wherein the cross-sectional profile of said support stem and cross-bar has an elliptical shape.

18. A hanger assembly for a hanger system for suspending linear fluorescent lighting elements below a grid ceiling system wherein the linear fluorescent lighting elements have spacially separated end portions holding at least one pair of opposed lamp sockets for holding at least one fluorescent lamp, said hanger assembly comprising a vertical support stem having a top and a bottom and first and second pairs of side-by-side wire holes running therethrough and exiting the top and bottom thereof, and a transverse hanger crossbar having a mid-portion and first and second hanger ends which extend in opposite directions from said mid-portion for connecting to linear lighting elements suspended by the hanger system near the lamp sockets held therein, said crossbar further having at least one pair of side-by-side wire holes running from the mid-portion thereof to the first of said hanger ends thereof, and at least one pair of side-by-side wire holes running from the mid-portion thereof to the second of said hanger ends, each of said at least one pair of wire holes in said crossbar exiting said mid-portion of the crossbar and the respective hanger ends of said crossbar, each wire hole of each of said pairs of wire holes in said support stem and crossbar being sized to slidably receive a pair of insulated wires pulled therethough, and the bottom of said support stem being connectable to the mid-portion of said crossbar such that the first and second pairs of wire holes running through said support stem communicate with the pairs of wire holes in said crossbar, whereby wires can be pulled through the support stem and crossbar, and whereby the crossbar can be connected to the bottom of the support stem to hide the wires pulled therethrough.

19. The hanger assembly of claim 18 wherein each of the pairs of wire holes in the support stem and crossbar of said hanger assembly overlap to create an intermediate gap between the side-by-side wire holes of each pair, said intermediate gap being sufficiently small that an insulated wire in one of the wire holes of said pair of wire holes cannot cross over into the other of the wire holes of said pair.

20. The hanger assembly of claim 18 wherein said support stem and said crossbar each have a common cross-sectional profile.

21. The hanger assembly of claim 18 wherein said support stem and said crossbar each have an elongated cross-sectional profile with a narrow dimension and a wide dimension, and wherein the pairs of wire holes in said support stem and crossbar are in side-by-side alignment with the wide dimension thereof.

22. The hanger assembly of claim 18 wherein the pairs of wire holes in said crossbar are comprised of at least one pair of wire holes that run between the hanger ends over the entire length thereof, and wherein an exit port is provided at the mid-portion of the cross-bar for said wire holes.

23. The hanger assembly of claim 22 wherein said support stem and said crossbar are fabricated of extruded aluminum.

24. The hanger assembly of claim 18 wherein said cross-bar has first and second pairs of wire holes running from the mid-portion of said cross-bar to both the first and second hanger ends of said crossbar such that a pair of wire holes is provided at each hanger end of the crossbar corresponding to one of the first and second pairs of wire holes running through said support stem.

25. The hanger assembly of claim 18 wherein said cross-bar has a downwardly arched shape having a apex at its mid-portion, wherein the pairs of wire holes in said crossbar exit at the apex thereof, and wherein the bottom of said support stem connects to the apex of said crossbar.

26. A hanger assembly for a hanger system for suspending linear fluorescent lighting elements below a grid ceiling system wherein the linear fluorescent lighting elements have spacially separated end portions holding at least one pair of opposed lamp sockets for holding at least one fluorescent lamp, said hanger assembly comprising a vertical support stem having a top and a bottom, a transverse hanger crossbar having a mid-portion, wire exit ports at said mid-portion, and first and second hanger ends which extend in opposite directions from said mid-portion for connecting to linear lighting elements suspended by the hanger assembly near the lamp sockets held therein, said support stem and crossbar having complimentary elongated cross-sectional profiles with a narrow dimension and a wide dimension, and first and second pairs of side-by-side wire holes running therethrough, the first and second pairs of wire holes in said support stem exiting the top and bottom thereof, and the first and second pairs of wire holes in said crossbar exiting the crossbar at the first and second hanger ends thereof and at the wire exit ports at the mid-portion thereof, the first and second pairs of wire holes in said support stem and crossbar being arranged in side-by-side alignment with the wide dimensions thereof, and the wire holes of each of such pairs of wire holes overlapping to create an intermediate gap therebetween, said intermediate gap being sufficiently small that an insulated wire in one of the wire holes of said pair of wire holes cannot cross over into the other of the wire holes of said pair, and the bottom of said support stem being connectable to the mid-portion of said crossbar such that the first and second pairs of wire holes running through said support stem communicate with the first and second pairs of wire holes in said crossbar, whereby wires can be pulled through the support stem and crossbar, and whereby the crossbar can be connected to the bottom of the support stem for hiding the wires pulled therethrough.

27. The hanger assembly of claim 26 wherein said support stem and crossbar have a center bore running therethrough between said pairs of wire holes, the center bore of said support stem exiting the top and bottom thereof between wire holes pairs, and the center bore of said crossbar exiting the hanger ends thereof between wire hole pairs.

28. The hanger assembly of claim 27 wherein the center bore in said support stem is threaded at the bottom of the support stem, and wherein a fastener hole extends through the mid-portion of said crossbar between the exit ports thereat for accepting a screw fastener that can be screwed into the threaded bore at the bottom of the support stem for connecting the bottom of the support stem to the crossbar, said fastener hole being located such that the exit ports at the mid-portion of said crossbar align with the pairs of wire holes exiting the bottom of the support stem when the crossbar is connected to the support stem.

29. The hanger assembly of claim 27 wherein each wire hole pair in said support stem and crossbar has an inside wire hole that is adjacent the center bore in said support stem and crossbar, and wherein each said inside wire hole is smaller than the other wire hole of said pair.

30. The hanger assembly of claim 26 wherein the wide dimension for the cross-sectional profile of said support stem and cross-bar is no greater than approximately ¾ inch.

31. The hanger assembly of claim 26 wherein the cross-sectional profile of said support stem and cross-bar has an elliptical shape.

* * * * *

UNITED STATES PATENT AND TRADEMARK OFFICE

CERTIFICATE OF CORRECTION

PATENT NO. : 7,329,022 B2 
APPLICATION NO. : 11/149939
DATED : February 12, 2008
INVENTOR(S) : Michael Trung Tran and Hue Ly It is certified that error appears in the above-identified patent and that said Letters Patent is hereby corrected as shown below:

Item [57] Abstract, line 5, “have two sets” should read --and two sets--.
Col. 1, line 56, “special” should read --spacial--.
Col. 1, line 56, “suspending” should read --suspended--.
Col. 1, line 64, “ton” should read --top--.
Col. 1, line 66, “ends” should read --end of the--.
Col. 1, line 67, “special” should read --spacial--.
Col. 2, line 1, “special” should read --spacial--.
Col. 2, line 3, “suspending” should read --suspended--.
Col. 2, lines 17-18, “crossbar. Whereby” should read --crossbar, whereby--.
Col. 2, line 23, “Preferably. Cross-section” should read --Preferably, cross-section--.
Col. 3, line 6, “and exploded” should read --an exploded--.
Col. 4, line 22, “34Δ” should read --34"--.
Col. 4, line 62, “tabs 73” should read --tab 73--.
Col. 6, line 20, claim 1, “suspending” should read --suspended--.
Col. 6, line 32, claim 1, “suspending” should read --suspended--.
Col. 7, line 30, claim 1, the word “is” before “connects” should be deleted.
Col. 7, line 34, claim 9, “suspending” should read --suspended--.
Col. 7, line 49, claim 9, “laterally of said” should read --laterally from said--.
Col. 7, line 64, claim 12, “suspending” should read --suspended--.
Col. 8, line 7, claim 12, “suspending” should read --suspended--.
Col. 10, line 6, claim 25, “a apex” should read --an apex--.

Signed and Sealed this

Twenty-fourth Day of June, 2008

JON W. DUDAS
*Director of the United States Patent and Trademark Office*